United States Patent [19]

McConnell

[11] 4,063,590

[45] Dec. 20, 1977

[54] PREHEATER FOR CLOTHES DRYER

[76] Inventor: Christopher L. McConnell, 3970 NW. 193rd St., Opa Locka, Fla. 33055

[21] Appl. No.: 734,814

[22] Filed: Oct. 22, 1976

[51] Int. Cl.[2] ..... F28F 3/12

[52] U.S. Cl. ..... 165/135; 34/86; 165/164; 165/DIG. 12

[58] Field of Search ..... 165/164, 165, 135, DIG. 12; 34/86

[56] References Cited

U.S. PATENT DOCUMENTS

| | | | |
|---|---|---|---|
| 2,303,247 | 11/1942 | Woods | 165/135 X |
| 2,445,471 | 7/1948 | Buckholdt | 165/135 X |
| 2,818,719 | 1/1958 | Cline | 34/86 X |
| 3,659,646 | 5/1972 | Hurbo et al. | 165/165 |

FOREIGN PATENT DOCUMENTS

| | | | |
|---|---|---|---|
| 809,863 | 8/1951 | Germany | 165/164 |
| 892,021 | 3/1962 | United Kingdom | 165/165 |

*Primary Examiner*—Albert W. Davis, Jr.
*Attorney, Agent, or Firm*—Oltman and Flynn

[57] ABSTRACT

The preheater for a clothes dryer preheats ambient air taken into the dryer by heat transfer from hot air discharged from the dryer, thus reducing the energy requirements of the dryer. The preheater includes a box with a heat conductive partition defining a first passage for flow of ambient air into the dryer and a second passage for flow of hot discharge air from the dryer reverse to the ambient air flow so that there is a relatively high temperature difference between the passages for effective heat transfer. Heat is transferred through the partition from discharge air to ambient air, and the partition has a serpentine configuration for increasing its heat exchanging surface area, thus improving heat transfer.

4 Claims, 6 Drawing Figures

PREHEATER FOR CLOTHES DRYER

BACKGROUND OF THE INVENTION

Preheaters for clothes dryers have been proposed previously. Examples of known preheaters are described in U.S. Pat. Nos. 3,859,735-Katterjohn and 2,818,719 — Cline.

SUMMARY OF THE INVENTION

The preheater of the present invention includes a box having a back for attachment to a clothes dryer, a heat conductive partition dividing the box into first and second passages and providing a heat exchange surface between the passages, and inlets and outlets for flow of ambient air through the first passage into the dryer and flow of the heated discharge air from the dryer through the second passage to the atmosphere in a direction reverse to the flow of ambient air. Heat is transferred through the partition from the discharge air to the ambient air with a relatively high temperature difference throughout the passages which increases heat transfer due to the reverse flow directions of ambient air and discharge air. The partition has a serpentine configuration which increases the heat exchanging surface area for improved heat transfer and defines channels in both of the passages for flow of air in contact with the partition.

Accordingly, it is an object of the present invention to increase the heat transferring efficiency of a preheater for a clothes dryer.

Another object of the invention is to provide a compact preheater for a clothes dryer which can lie flat against the back of the dryer.

A further object of the invention is to provide a serpentine heat exchanging surface in a preheater for increased heat transfer.

Other objects of this invention will appear from the following description and appended claims, reference being had to the accompanying drawings forming a part of this specification wherein like reference characters designate corresponding parts in the several views.

Figure 1:
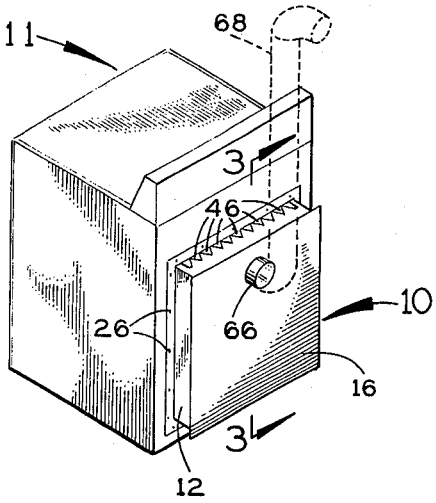
FIG. 1 is a perspective view of a clothes dryer and a preheater attached to the back of the dryer in accordance with a preferred embodiment.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DETAILED DESCRIPTION

The preheater 10 is designed to be attached to the back of a clothes dryer 11 for preheating ambient air which is supplied to the dryer. The ambient air is heated further within the dryer by heating elements (not shown) which are thermostatically controlled. By preheating the ambient air before it enters the dryer, the heating elements need not be activated for as much of the cycle in order to maintain the proper temperature within the dryer. Thus, the energy requirements of the heating elements are reduced by use of the preheater 10.

The preheater 10 includes a box 12 which has a back wall 14, a front wall 16, a top wall 18, a bottom wall 20 and two vertical side walls 22 and 24. The back 14 can be attached directly to the back of the dryer 12 over an opening in the back of the dryer so that the back 14 forms the covering for the back of the dryer. The box 12 is compact and lies flat against the dryer. The back 14 may be fastened as with screws 26. The sides 18, 20, 22 and 24 have lips 28 with openings in them for receiving screws 30 for attaching the back 14 to walls 18, 20, 22 and 24. These walls also have apertured lips 32 facing the front 16 so that the front can be attached to the vertical and horizontal side walls as with screws 34. All of the walls may be made of sheet metal. A gasket 27 may be used to seal the edges of the back 14.

Figures 3, 4, 5, 6:
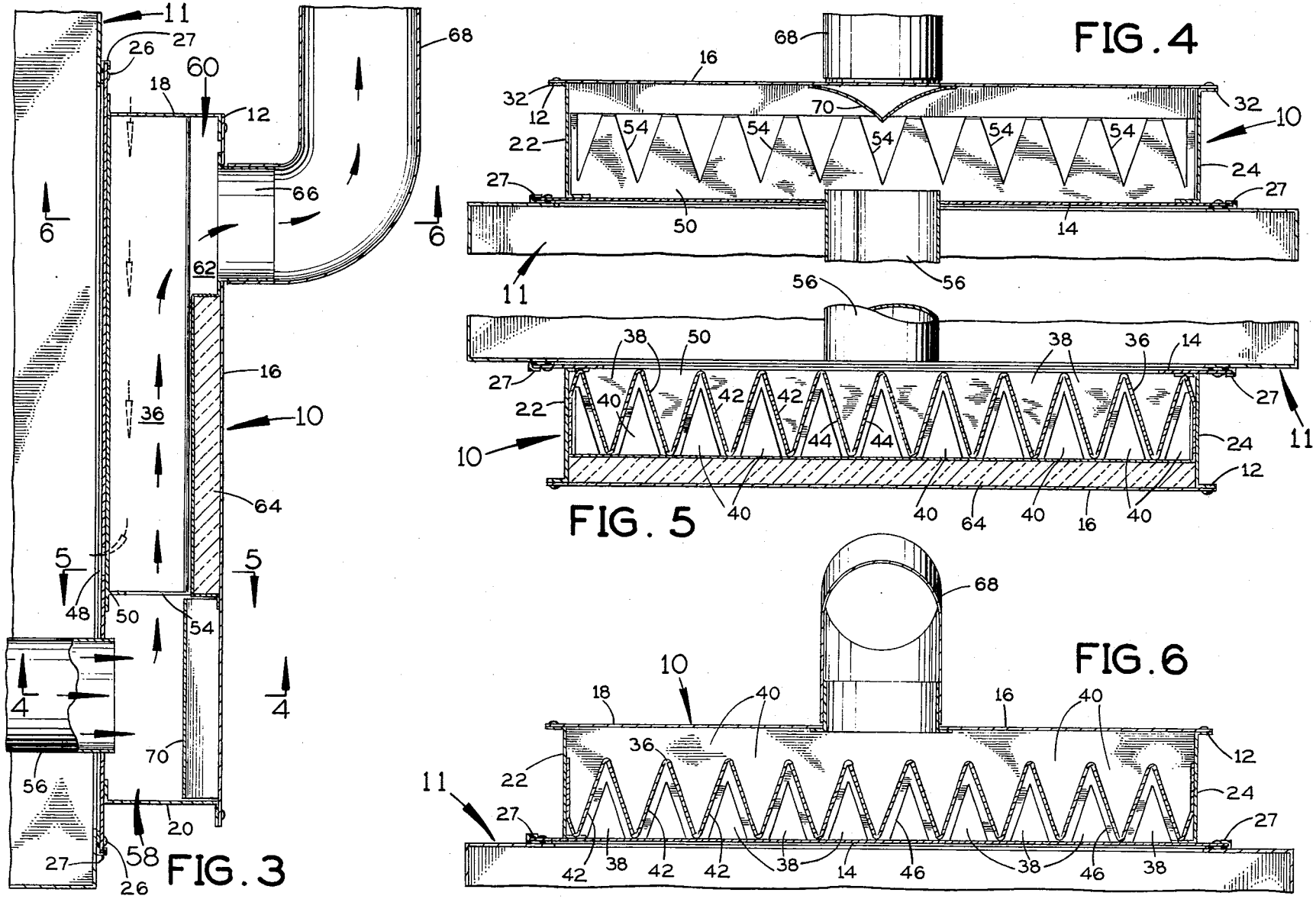
FIG. 3 is a vertical sectional view of the preheater taken along line 3—3 of FIG. 1.
FIG. 4 is a sectional view taken along line 4—4 of FIG. 3 and looking up.
FIG. 5 is a sectional view taken along line 5—5 of FIG. 3 and looking down.
FIG. 6 is a sectional view taken along line 6—6 of FIG. 3 and looking up.

Within the box 12, there is a heat conductive partition 36 which may also be made of sheet metal. The partition 36 divides the interior of the box 12 into a first passage means 38 (FIG. 6) and a second passage means 40 (FIG. 5). The first passage means 38 is located next to the back of the dryer and provides a path indicated by dashed arrows in FIG. 3 for flow of ambient air through the first passage means 38 into the dryer. The second passage means 40 is separated from the back of the dryer by the first passage means and the partition 36, and it provides a path indicated by solid line arrows in FIG. 3 for flow of heated discharge air from the dryer through the second passage means to the atmosphere.

Heat is transferred through the partition 36 from the discharge air to the ambient air within the passage means. The partition 36 preferrably has a serpentine configuration in horizontal cross section as shown in FIGS. 5 and 6 for increasing the heat exchanging surface area thereof and thus improving heat transfer. The serpentine partition 36 divides the passage means 38 into a plurality of channels 42 and divides the second passage means 40 into a plurality of channels 44. The air flows within these channels in contact with the partition 36.

Figure 2:
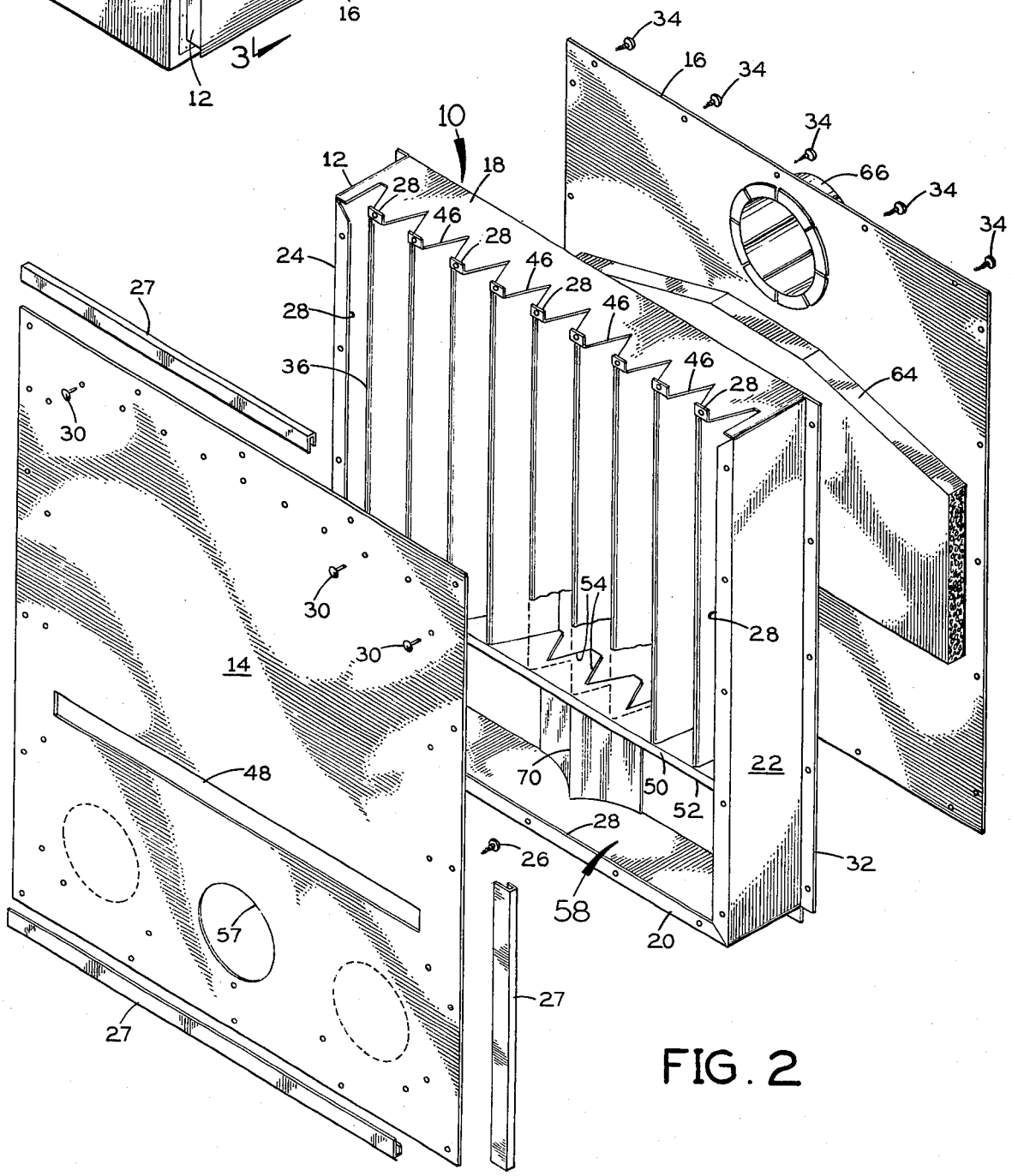
FIG. 2 is an exploded perspective view of the preheater.

The top 18 of the box 12 has a triangular opening 46 for communicating each of the channels 42 with the atmosphere and providing a first inlet for intake of ambient air into the passage means 38. As shown in FIGS. 2 and 3, the back 14 has a horizontally elongated opening 48 at the bottom of the first passage means 38 leading into the dryer 12 for providing a first outlet from the first passage means 38 for flow of ambient air from the passage means into the dryer.

There is a transverse wall 50 within the box 12 located at the bottom of the first passage means 38. The wall 50 is attached to the front and back of the box as with screws passing through lips 52. The wall 50 covers the bottom ends of the channels 42 of the first passage means 38 as shown in FIG. 5. The wall 50 has a triangular opening 54 leading into the bottom end of each of the channels 44 for the second passage means 40 for allowing heated discharge air to enter the second passage means. Thus, the openings 54 are part of a second inlet for flow of heated discharge air into the second passage means.

Also included within this second inlet are a discharge conduit 56 through which the heated discharge air flows out of the dryer, and an inlet plenum 58 located within the box 12 underneath the wall 50. The conduit 56 passes through opening 57 in back 14, and opening 57 could have alternate locations as shown with dashed circles in FIG. 2. The box 12 also contains an outlet plenum 60 located at the top of the box 12 as shown in FIG. 3. The partition 36 is narrower than the transverse width of the box 12 so as to define a space at 62 between the plenums 58 and 60. A blocking pad 64 is attached to the front 16 and is located within the space 62 so as to block flow of air between the plenums 58 and 60 except through the second passage means 40. The blocking pad 64 may be made of thermal insulation material covered with foil or any other suitable material.

The outlet plenum 60 and an outlet conduit 66 provide a second outlet for the second passage means 40 at the top of the second passage means. This outlet may be connected to a stack 68 for exhausting the discharge air to the atmosphere. Within the plenum 58 there is a V-shaped diffuser 70 for spreading discharge air through the plenum and the second passage means.

The ambient air and the discharge air flow in reverse directions within the two passage means 38 and 40 as indicated by the dashed line arrows and the solid line arrows in FIG. 3. Thus, there is a relatively high temperature difference between the ambient air and the discharge air throughout the two passage means due to reverse flows of air for improving the efficiency of heat transfer. As previously mentioned, the serpentine configuration of the partition 36 also improves the efficiency of heat transfer. In tests on the preheater in operation with an ambient air temperature of 85° F. and a discharge air temperature coming out of the dryer of 150° F., the ambient air was preheated to a temperature of 135° F. where it enters the dryer, and the temperature of the discharge air dropped to 135° F. where it leaves the preheater. Substantially 100% of the ambient intake air for the dryer passes through the first passage means 38.

Having thus described my invention, I claim:

1. In a preheater for attachment to the back of a clothes dryer which takes in ambient air at the back and discharges moist heated air at the back, the improvement wherein said preheater comprises:

box means having a back with means for attachment to the back of the clothes dryer;

heat conductive partition means dividing said box means into first and second passage means for providing a heat exchange surface between said passage means, said partition means extending substantially vertically when said box means is attached to the back of the clothes dryer with said first passage means next to the back of the dryer said second passage means separated from the back of the dryer by said first passage means, said partition means having a serpentine configuration in horizontal cross-section for increasing the heat exchanging surface area thereof and defining vertical channels in both of said passage means for flow of air in contact with said partition means;

first inlet means for intake of ambient air located substantially at the top of said first passage means, and first outlet means located substantially at the bottom of said first passage means for discharging preheated ambient air into said clothes dryer;

second inlet means for intake of heated air discharged from said dryer into said second passage means located substantially at the bottom thereof, and second outlet means located at substantially the top of said second passage means for flow in said second passage means of the heated discharge air reverse to the flow of the ambient air and exhaust of the discharge air from said second outlet means;

said second inlet means including an inlet plenum opening into said second passage means;

said inlet plenum including diffuser means for diffusing heated discharge air through said second passage means;

said second outlet means including an outlet plenum into which said second passage means opens;

said serpentine partition means being narrower than said box means and defining a space in said box means between said plenums; and said preheater further including blocking means in said space for blocking flow of air between said plenums except through said second passage means;

said partition means serving to transfer heat from the discharge air to the ambient air in said passage means for preheating the ambient air supplied to the dryer with a relatively high temperature difference between the ambient air and the discharge air throughout said passage means due to the reverse flows thereof;

and said diffuser means comprising a substantially V-shaped member affixed to the front of said box means in said inlet plenum.

2. In a preheater for attachment to the back of a clothes dryer which takes in ambient air at the back and discharges moist heated air at the back, said preheater comprising:

box means having a back wall for attachment to the back of the clothes dryer and a front wall spaced from its back wall;

heat conductive partition means in said box means extending substantially vertically when said box means is attached to the back of the clothes dryer, said partition means in horizontal cross-section extending in serpentine fashion between said back and said front wall of said box means to divide the interior of said box means into alternate substantially vertical ambient air intake passages next to said back wall and substantially vertical heated air discharge passages facing toward said front wall;

means providing air inlets at the upper end of said ambient air intake passages;

said box means defining a heated air inlet plenum which leads into the lower end of said heated air discharge passages and has an inlet in said back wall for receiving heated air discharged from the clothes dryer;

and said box means defining a heated air outlet plenum leading from the upper end of said heated air discharge passages;

the improvement which comprises:

means defining an air outlet opening in said back wall at the lower end of said ambient air intake passages for passing ambient intake air from the latter into the clothes dryer;

and means for insulating said heated air discharge passages at said front wall of said box means said insulating means being engaged between said front wall and the adjacent segments of said heat conductive partition means to close said heated air discharge passages at the front between said plenums for blocking heat transfer from said heated air discharge passages to said front wall of said box means whereby to minimize the loss of heat from said heated air discharge passages through said front wall and thereby enhance the heat exchange from said heated air discharge passages through said heat conductive partition means to said ambient air intake passages for preheating the ambient air going into the clothes dryer.

3. A preheater according to claim 2, and further comprising transverse partition means located in said box means at the lower end of said ambient air intake passages and above said heated air inlet plenum, said partition means blocking said ambient air intake passages from said heated air inlet plenum, and said air outlet in the back wall of said box means at the lower end of said ambient air intake passages being located above said partition means.

4. A prehater according to claim 3, wherein said air outlet in the back wall of said box means is horizontally elongated.

* * * * *